US010849200B2

(12) United States Patent
Holec et al.

(10) Patent No.: US 10,849,200 B2
(45) Date of Patent: Nov. 24, 2020

(54) SOLID STATE LIGHTING CIRCUIT WITH CURRENT BIAS AND METHOD OF CONTROLLING THEREOF

(71) Applicant: Metrospec Technology, L.L.C., Mendota Heights, MN (US)

(72) Inventors: Henry V. Holec, Mendota Heights, MN (US); Brian Hillstrom, Rockford, MN (US)

(73) Assignee: Metrospec Technology, L.L.C., Mendota Heights, MN (US)

( * ) Notice: Subject to any disclaimer, the term of this patent is extended or adjusted under 35 U.S.C. 154(b) by 0 days.

(21) Appl. No.: 16/585,846

(22) Filed: Sep. 27, 2019

(65) Prior Publication Data

US 2020/0107412 A1 Apr. 2, 2020

Related U.S. Application Data

(60) Provisional application No. 62/738,728, filed on Sep. 28, 2018.

(51) Int. Cl.
*H05B 37/02* (2006.01)
*H05B 45/20* (2020.01)
(Continued)

(52) U.S. Cl.
CPC ..... *H05B 45/20* (2020.01); *G05F 1/573* (2013.01); *H05B 45/14* (2020.01); *H05B 45/10* (2020.01)

(58) Field of Classification Search
CPC ..... H05B 45/10; H05B 45/20
See application file for complete search history.

(56) References Cited

U.S. PATENT DOCUMENTS 2,697,811 A 12/1954 Deming
2,731,609 A 1/1956 Sobell, III
(Continued)

FOREIGN PATENT DOCUMENTS

CN 201242082 5/2009
CN 201731316 2/2011
(Continued)

OTHER PUBLICATIONS

"3M Thermally Conductive Adhesive Transfer Tapes—Technical Data," Electronic Adhesives and Specialties Department, Engineered Adhesives Division, Sep. 2002, (pp. 1-6).
"Custom LUXEON Design Guide," Application Brief AB12, Mar. 2006 (14 pages).
"Derwent-Acc-No: 1984-298425," corresponds to JP-59-186388A (1984).
(Continued)

*Primary Examiner* — Thuy Vinh Tran
(74) *Attorney, Agent, or Firm* — Pauly, DeVries Smith & Deffner LLC

(57) ABSTRACT

In an embodiment, a solid-state lighting circuit is included herein having a first plurality of emitters configured to output light of a first color and a second plurality of emitters configured to output light of a second color. The circuit further includes a current limiting circuit and at least one biasing resistor operably connected to the first plurality of emitters and the current limiting circuit. Current is biased toward the first plurality of emitters until a preselected current limit is reached for the first plurality of emitters, such that the first plurality of emitters outputs the light of the first color. When current is provided by the constant current power supply that is at or above the preselected current limit, current passes through the second plurality of emitters such that the second plurality of emitters outputs the light of the second color. Other embodiments are also included herein.

22 Claims, 7 Drawing Sheets

(51) Int. Cl.

| | |
|---|---|
| ***G05F 1/573*** | (2006.01) |
| ***H05B 45/14*** | (2020.01) |
| *H05B 45/10* | (2020.01) |

(56) References Cited

U.S. PATENT DOCUMENTS

| | | | |
|---|---|---|---|
| 3,028,573 | A | 4/1962 | Stoehr |
| 3,086,189 | A | 4/1963 | Robbins |
| 3,270,251 | A | 8/1966 | Evans |
| 3,401,369 | A | 9/1968 | Plamateer et al. |
| 3,499,098 | A | 3/1970 | Mcgahey et al. |
| 3,585,403 | A | 6/1971 | Gribbons |
| 3,628,999 | A | 12/1971 | Schneble, Jr. et al. |
| 3,640,519 | A | 2/1972 | William et al. |
| 3,745,091 | A | 7/1973 | Mccormick |
| 4,017,847 | A | 4/1977 | Burford et al. |
| 4,150,421 | A | 4/1979 | Nishihara et al. |
| 4,173,035 | A | 10/1979 | Hoyt |
| 4,249,303 | A | 2/1981 | Greenwood et al. |
| 4,250,536 | A | 2/1981 | Barringer et al. |
| 4,285,780 | A | 8/1981 | Schachter |
| 4,388,136 | A | 6/1983 | Jacobus et al. |
| 4,515,304 | A | 5/1985 | Berger |
| 4,521,969 | A | 6/1985 | Greenwood |
| 4,526,432 | A | 7/1985 | Cronin et al. |
| 4,533,188 | A | 8/1985 | Miniet |
| 4,618,194 | A | 10/1986 | Kwilos |
| 4,685,210 | A | 8/1987 | King et al. |
| 4,761,881 | A | 8/1988 | Bora et al. |
| 4,795,079 | A | 1/1989 | Yamada |
| 4,815,981 | A | 3/1989 | Mizuno |
| 4,842,184 | A | 6/1989 | Miller, Jr. |
| 4,871,315 | A | 10/1989 | Noschese |
| 4,950,527 | A | 8/1990 | Yamada |
| 4,991,290 | A | 2/1991 | Mackay |
| 5,001,605 | A | 3/1991 | Savagian et al. |
| 5,041,003 | A | 8/1991 | Smith et al. |
| 5,093,985 | A | 3/1992 | Houldsworth et al. |
| 5,103,382 | A | 4/1992 | Kondo et al. |
| 5,155,904 | A | 10/1992 | Majd |
| 5,176,255 | A | 1/1993 | Seidler |
| 5,224,023 | A | 6/1993 | Smith et al. |
| 5,254,910 | A | 10/1993 | Yang |
| 5,375,044 | A | 12/1994 | Guritz |
| 5,404,044 | A | 4/1995 | Booth et al. |
| 5,440,454 | A | 8/1995 | Hashimoto et al. |
| 5,478,008 | A | 12/1995 | Takahashi |
| 5,511,719 | A | 4/1996 | Miyake et al. |
| 5,523,695 | A | 6/1996 | Lin |
| 5,563,777 | A | 10/1996 | Miki et al. |
| 5,575,554 | A | 11/1996 | Guritz |
| 5,585,675 | A | 12/1996 | Knopf |
| 5,677,598 | A | 10/1997 | De Hair et al. |
| 5,887,158 | A | 3/1999 | Sample et al. |
| 5,917,149 | A | 6/1999 | Barcley et al. |
| 5,920,465 | A | 7/1999 | Tanaka |
| 5,984,691 | A | 11/1999 | Brodsky et al. |
| 6,040,624 | A | 3/2000 | Chambers et al. |
| 6,065,666 | A | 5/2000 | Backlund |
| 6,089,442 | A | 7/2000 | Ouchi et al. |
| 6,095,405 | A | 8/2000 | Kim et al. |
| 6,100,475 | A | 8/2000 | Degani et al. |
| 6,113,248 | A | 9/2000 | Mistopoulos et al. |
| 6,130,823 | A | 10/2000 | Lauder et al. |
| 6,137,816 | A | 10/2000 | Kinbara |
| 6,199,273 | B1 | 3/2001 | Kubo et al. |
| 6,226,862 | B1 | 5/2001 | Neuman |
| 6,239,716 | B1 | 5/2001 | Pross et al. |
| 6,299,337 | B1 | 10/2001 | Bachl et al. |
| 6,299,469 | B1 | 10/2001 | Glovatsky et al. |
| 6,310,445 | B1 | 10/2001 | Kashaninejad |
| 6,372,997 | B1 | 4/2002 | Hill et al. |
| 6,384,339 | B1 | 5/2002 | Neuman |
| 6,428,189 | B1 | 8/2002 | Hochstein |
| 6,429,383 | B1 | 8/2002 | Sprietsma et al. |
| 6,448,661 | B1 | 9/2002 | Kim et al. |
| 6,449,836 | B1 | 9/2002 | Miyake et al. |
| 6,465,084 | B1 | 10/2002 | Curcio et al. |
| 6,481,874 | B2 | 11/2002 | Petroski |
| 6,498,440 | B2 | 12/2002 | Stam et al. |
| 6,517,218 | B2 | 2/2003 | Hochstein |
| 6,555,756 | B2 | 4/2003 | Nakamura et al. |
| 6,578,986 | B2 | 6/2003 | Swaris et al. |
| 6,580,228 | B1 | 6/2003 | Chen et al. |
| 6,589,594 | B1 | 7/2003 | Hembree |
| 6,601,292 | B2 | 8/2003 | Li et al. |
| 6,651,322 | B1 | 11/2003 | Currie |
| 6,657,297 | B1 | 12/2003 | Jewram et al. |
| 6,729,888 | B2 | 5/2004 | Imaeda |
| 6,746,885 | B2 | 6/2004 | Cao |
| 6,784,027 | B2 | 8/2004 | Streubel |
| 6,833,526 | B2 | 12/2004 | Sinkunas et al. |
| 6,846,094 | B2 | 1/2005 | Luk |
| 6,851,831 | B2 | 2/2005 | Karlicek, Jr. et al. |
| 6,884,313 | B2 | 4/2005 | Lee et al. |
| 6,897,622 | B2 | 5/2005 | Lister |
| 6,898,084 | B2 | 5/2005 | Misra |
| 6,902,099 | B2 | 6/2005 | Motonishi et al. |
| 6,919,529 | B2 | 7/2005 | Franzen et al. |
| 6,936,855 | B1 | 8/2005 | Harrah |
| 6,963,175 | B2 | 11/2005 | Archenhold et al. |
| 6,966,674 | B2 | 11/2005 | Tsai |
| 6,991,473 | B1 | 1/2006 | Balcome et al. |
| 6,996,674 | B2 | 2/2006 | Chiu et al. |
| 7,023,147 | B2 | 4/2006 | Colby et al. |
| 7,037,114 | B1 | 5/2006 | Eiger et al. |
| 7,086,756 | B2 | 8/2006 | Maxik |
| 7,086,767 | B2 | 8/2006 | Sidwell et al. |
| 7,114,831 | B2 | 10/2006 | Popovich et al. |
| 7,114,837 | B2 | 10/2006 | Yagi et al. |
| 7,149,097 | B1 | 12/2006 | Shteynberg et al. |
| 7,199,309 | B2 | 4/2007 | Chamberlin et al. |
| 7,204,615 | B2 | 4/2007 | Arik et al. |
| 7,210,818 | B2 | 5/2007 | Luk et al. |
| 7,248,245 | B2 | 7/2007 | Adachi et al. |
| 7,253,449 | B2 | 8/2007 | Wu |
| 7,256,554 | B2 | 8/2007 | Lys |
| 7,262,438 | B2 | 8/2007 | Mok et al. |
| 7,263,769 | B2 | 9/2007 | Morimoto et al. |
| 7,276,861 | B1 | 10/2007 | Shteynberg et al. |
| 7,284,882 | B2 | 10/2007 | Burkholder |
| 7,325,955 | B2 | 2/2008 | Lucas et al. |
| 7,331,796 | B2 | 2/2008 | Hougham et al. |
| 7,341,476 | B2 | 3/2008 | Soeta |
| 7,344,279 | B2 | 3/2008 | Mueller et al. |
| 7,377,669 | B2 | 5/2008 | Farmer et al. |
| 7,377,787 | B1 | 5/2008 | Eriksson |
| 7,394,027 | B2 | 7/2008 | Kaluzni et al. |
| 7,397,068 | B2 | 7/2008 | Park et al. |
| 7,448,923 | B2 | 11/2008 | Uka |
| 7,459,864 | B2 | 12/2008 | Lys |
| 7,497,695 | B2 | 3/2009 | Uchida et al. |
| 7,502,846 | B2 | 3/2009 | Mccall |
| 7,514,880 | B2 | 4/2009 | Huang et al. |
| 7,543,961 | B2 | 6/2009 | Arik et al. |
| 7,547,124 | B2 | 6/2009 | Chang et al. |
| 7,550,930 | B2 | 6/2009 | Cristoni et al. |
| 7,553,051 | B2 | 6/2009 | Brass et al. |
| 7,556,405 | B2 | 7/2009 | Kingsford et al. |
| 7,556,406 | B2 | 7/2009 | Petroski et al. |
| 7,573,210 | B2 | 8/2009 | Ashdown et al. |
| 7,583,035 | B2 | 9/2009 | Shteynberg et al. |
| 7,598,685 | B1 | 10/2009 | Shteynberg et al. |
| 7,656,103 | B2 | 2/2010 | Shteynberg et al. |
| 7,665,999 | B2 | 2/2010 | Hougham et al. |
| 7,696,628 | B2 | 4/2010 | Ikeuchi et al. |
| 7,710,047 | B2 | 5/2010 | Shteynberg et al. |
| 7,710,050 | B2 | 5/2010 | Preston et al. |
| 7,777,236 | B2 | 8/2010 | Pachler |
| 7,800,315 | B2 | 9/2010 | Shteynberg et al. |
| 7,800,316 | B2 | 9/2010 | Haug at al. |
| 7,806,572 | B2 | 10/2010 | Mcfadden et al. |
| 7,810,955 | B2 | 10/2010 | Stimac et al. |
| 7,852,009 | B2 | 12/2010 | Coleman et al. |

(56) References Cited

U.S. PATENT DOCUMENTS 7,852,300 B2 12/2010 Shteynberg et al.
7,880,400 B2 2/2011 Zhou et al.
7,888,881 B2 2/2011 Shteynberg et al.
7,902,769 B2 3/2011 Shteynberg et al.
7,902,771 B2 3/2011 Shteynberg et al.
7,943,940 B2 5/2011 Boonekamp et al.
7,952,294 B2 5/2011 Shteynberg et al.
7,956,554 B2 6/2011 Shteynberg et al.
7,977,698 B2 7/2011 Ling et al.
7,980,863 B1 7/2011 Holec et al.
8,004,211 B2 8/2011 Van Erp
8,007,286 B1 8/2011 Holec et al.
8,011,806 B2 9/2011 Shiraishi et al.
8,038,329 B2 10/2011 Takahasi et al.
8,045,312 B2 10/2011 Shrier
8,061,886 B1 11/2011 Kraus, Jr. et al.
8,065,794 B2 11/2011 En et al.
8,067,896 B2 11/2011 Shteynberg et al.
8,075,477 B2 12/2011 Nakamura et al.
8,115,370 B2 2/2012 Huang
8,124,429 B2 2/2012 Norman
8,137,113 B2 3/2012 Ouchi et al.
8,143,631 B2 3/2012 Crandell et al.
8,162,200 B2 4/2012 Buchwalter et al.
8,166,650 B2 5/2012 Thomas
8,210,422 B2 7/2012 Zadesky
8,210,424 B2 7/2012 Weibezahn
8,227,962 B1 7/2012 Su
8,232,735 B2 7/2012 Shteynberg et al.
8,242,704 B2 8/2012 Lethellier
8,253,349 B2 8/2012 Shteynberg et al.
8,253,666 B2 8/2012 Shteynberg et al.
8,264,169 B2 9/2012 Shteynberg et al.
8,264,448 B2 9/2012 Shteynberg et al.
8,277,078 B2 10/2012 Tanaka
8,278,840 B2 10/2012 Logiudice et al.
8,410,720 B2 4/2013 Holec et al.
8,500,456 B1 8/2013 Holec et al.
8,525,193 B2 9/2013 Crandell et al.
8,618,669 B2 12/2013 Furuta
8,698,423 B2 4/2014 Zhang et al.
8,710,764 B2 4/2014 Holec et al.
8,716,952 B2 5/2014 Van De Ven
8,847,516 B2 * 9/2014 Chobot ..... H05B 45/20 315/307
8,851,356 B1 10/2014 Holec et al.
8,866,416 B2 10/2014 Burrows et al.
8,947,389 B1 2/2015 Shin et al.
8,968,006 B1 3/2015 Holec et al.
9,049,769 B2 6/2015 Secilmis
9,185,755 B2 11/2015 Sutardja et al.
9,253,844 B2 * 2/2016 Grajcar ..... H05B 45/20
9,271,363 B2 * 2/2016 Takatsu ..... H05B 45/10
9,320,109 B2 4/2016 Lai
9,341,355 B2 5/2016 Crandell et al.
9,357,639 B2 5/2016 Holec et al.
9,474,154 B2 10/2016 Johansson et al.
9,538,604 B2 1/2017 Yadav et al.
9,544,969 B2 1/2017 Baddela et al.
9,668,307 B2 5/2017 Roberts et al.
9,736,946 B2 8/2017 Holec et al.
10,334,735 B2 6/2019 Holec et al.
10,499,511 B2 12/2019 Holec et al.
2001/0000906 A1 5/2001 Yoshikawa et al.
2001/0004085 A1 6/2001 Gueissaz
2002/0014518 A1 2/2002 Totani et al.
2002/0043402 A1 4/2002 Juskey et al.
2002/0094705 A1 7/2002 Driscoll et al.
2002/0105373 A1 8/2002 Sudo
2002/0148636 A1 10/2002 Belke et al.
2002/0179331 A1 12/2002 Brodsky et al.
2003/0040166 A1 2/2003 Moshayedi
2003/0052594 A1 3/2003 Matsui et al.
2003/0062195 A1 4/2003 Arrigotti et al.
2003/0072153 A1 4/2003 Matsui et al.
2003/0079341 A1 5/2003 Miyake et al.
2003/0092293 A1 5/2003 Ohtsuki et al.
2003/0094305 A1 5/2003 Ueda
2003/0098339 A1 5/2003 Totani et al.
2003/0137839 A1 7/2003 Lin
2003/0146018 A1 8/2003 Sinkunas et al.
2003/0193789 A1 10/2003 Karlicek, Jr.
2003/0193801 A1 10/2003 Lin et al.
2003/0199122 A1 10/2003 Wada et al.
2003/0223210 A1 12/2003 Chin
2004/0007981 A1 1/2004 Shibata et al.
2004/0055784 A1 3/2004 Joshi et al.
2004/0060969 A1 4/2004 Imai et al.
2004/0079193 A1 4/2004 Kokubo et al.
2004/0087190 A1 5/2004 Miyazawa et al.
2004/0090403 A1 5/2004 Huang
2004/0239243 A1 12/2004 Roberts et al.
2004/0264148 A1 12/2004 Burdick, Jr. et al.
2005/0056923 A1 3/2005 Moshayedi
2005/0067472 A1 3/2005 Ohtsuki et al.
2005/0133800 A1 6/2005 Park et al.
2005/0207156 A1 9/2005 Wang et al.
2005/0239300 A1 10/2005 Yasumura et al.
2005/0242160 A1 11/2005 Nippa et al.
2005/0272276 A1 12/2005 Ooyabu
2006/0000877 A1 1/2006 Wang et al.
2006/0022051 A1 2/2006 Patel et al.
2006/0025023 A1 2/2006 Ikeda et al.
2006/0038542 A1 2/2006 Park et al.
2006/0128174 A1 6/2006 Jang et al.
2006/0181878 A1 8/2006 Burkholder
2006/0220051 A1 10/2006 Fung et al.
2006/0221609 A1 10/2006 Ryan
2006/0245174 A1 11/2006 Ashdown et al.
2006/0284640 A1 12/2006 Wang et al.
2007/0015417 A1 1/2007 Caveney et al.
2007/0054517 A1 3/2007 Hidaka at al.
2007/0077688 A1 4/2007 Hsu et al.
2007/0157464 A1 7/2007 Jeon et al.
2007/0171145 A1 7/2007 Coleman et al.
2007/0184675 A1 8/2007 Ishikawa et al.
2007/0194428 A1 8/2007 Sato et al.
2007/0210722 A1 9/2007 Konno et al.
2007/0216987 A1 9/2007 Hagood et al.
2007/0217202 A1 9/2007 Sato
2007/0252268 A1 11/2007 Chew et al.
2007/0257623 A1 11/2007 Johnson et al.
2008/0031640 A1 2/2008 Fukui
2008/0045077 A1 2/2008 Chou et al.
2008/0138576 A1 6/2008 Nozu et al.
2008/0143379 A1 6/2008 Norman
2008/0144322 A1 6/2008 Norfidathul et al.
2008/0160795 A1 7/2008 Chen et al.
2008/0191642 A1 8/2008 Slot et al.
2008/0232047 A1 9/2008 Yamada et al.
2008/0249363 A1 10/2008 Nakamura et al.
2008/0254653 A1 10/2008 Uka
2008/0310141 A1 12/2008 Mezouari
2008/0311771 A1 12/2008 Cho
2009/0029570 A1 1/2009 Ikeuchi et al.
2009/0079357 A1 3/2009 Shteynberg et al.
2009/0103302 A1 4/2009 Lin et al.
2009/0117373 A1 5/2009 Wisniewski et al.
2009/0140415 A1 6/2009 Furuta
2009/0191725 A1 7/2009 Vogt et al.
2009/0205200 A1 8/2009 Rosenblatt et al.
2009/0226656 A1 9/2009 Crandell et al.
2009/0230883 A1 9/2009 Haug
2009/0251068 A1 10/2009 Holec et al.
2009/0301544 A1 12/2009 Minelli
2009/0308652 A1 12/2009 Shih
2010/0008090 A1 1/2010 Li et al.
2010/0018763 A1 1/2010 Barry
2010/0026208 A1 2/2010 Shteynberg et al.
2010/0059254 A1 3/2010 Sugiyama et al.
2010/0093190 A1 4/2010 Miwa et al.
2010/0109536 A1 5/2010 Jung et al.

(56) References Cited

U.S. PATENT DOCUMENTS

| | | | | |
|---|---|---|---|---|
| 2010/0110682 | A1 | 5/2010 | Jung et al. | |
| 2010/0167561 | A1 | 7/2010 | Brown et al. | |
| 2010/0187005 | A1 | 7/2010 | Yeh | |
| 2010/0213859 | A1 | 8/2010 | Shteynberg et al. | |
| 2010/0220046 | A1 | 9/2010 | Plötz et al. | |
| 2010/0308738 | A1 | 12/2010 | Shteynberg et al. | |
| 2010/0308739 | A1 | 12/2010 | Shteynberg et al. | |
| 2011/0019399 | A1 | 1/2011 | Van et al. | |
| 2011/0024180 | A1 | 2/2011 | Ko | |
| 2011/0031894 | A1 | 2/2011 | Van | |
| 2011/0051448 | A1 | 3/2011 | Owada | |
| 2011/0068701 | A1 | 3/2011 | Van et al. | |
| 2011/0096545 | A1 | 4/2011 | Chang | |
| 2011/0115411 | A1 | 5/2011 | Shteynberg et al. | |
| 2011/0121754 | A1 | 5/2011 | Shteynberg et al. | |
| 2011/0157897 | A1 | 6/2011 | Liao et al. | |
| 2011/0177700 | A1 | 7/2011 | Jia et al. | |
| 2011/0230067 | A1 | 9/2011 | Champion et al. | |
| 2011/0309759 | A1 | 12/2011 | Shteynberg et al. | |
| 2011/0311789 | A1 | 12/2011 | Loy et al. | |
| 2012/0002438 | A1 | 1/2012 | Gourlay | |
| 2012/0014108 | A1 | 1/2012 | Greenfield et al. | |
| 2012/0068622 | A1 | 3/2012 | Ward | |
| 2012/0081009 | A1 | 4/2012 | Shteynberg et al. | |
| 2012/0081018 | A1 | 4/2012 | Shteynberg et al. | |
| 2012/0097784 | A1 | 4/2012 | Liao et al. | |
| 2012/0162990 | A1 | 6/2012 | Crandell et al. | |
| 2012/0188771 | A1 | 7/2012 | Kraus et al. | |
| 2012/0195024 | A1 | 8/2012 | Kawaguchi et al. | |
| 2012/0281411 | A1 | 11/2012 | Kajiya et al. | |
| 2013/0070452 | A1 | 3/2013 | Urano et al. | |
| 2013/0128582 | A1 | 5/2013 | Holec et al. | |
| 2013/0169187 | A1 | 7/2013 | Lai | |
| 2013/0207556 | A1* | 8/2013 | Grajcar | H05B 45/10 315/186 |
| 2013/0320523 | A1 | 12/2013 | Lee et al. | |
| 2014/0015414 | A1 | 1/2014 | Holec et al. | |
| 2014/0168982 | A1 | 6/2014 | Crandell et al. | |
| 2014/0197743 | A1 | 7/2014 | Holec et al. | |
| 2014/0203729 | A1 | 7/2014 | Van De Ven | |
| 2014/0210357 | A1 | 7/2014 | Yan et al. | |
| 2014/0361711 | A1* | 12/2014 | Takahashi | H05B 45/395 315/294 |
| 2015/0173183 | A1 | 6/2015 | Holec et al. | |
| 2015/0189765 | A1 | 7/2015 | Holec et al. | |
| 2017/0055346 | A1 | 2/2017 | Holec et al. | |
| 2017/0280532 | A1* | 9/2017 | Akiyama | H05B 45/20 |
| 2018/0063968 | A1 | 3/2018 | Holec et al. | |

FOREIGN PATENT DOCUMENTS

| | | |
|---|---|---|
| CN | 102788284 | 11/2012 |
| DE | 102009055859 | 6/2011 |
| EP | 0961351 | 12/1999 |
| EP | 2505044 | 10/2012 |
| EP | 2888517 | 7/2015 |
| GB | 2483942 | 3/2012 |
| JP | 59186388 | 10/1984 |
| JP | 01319993 | 12/1989 |
| JP | 05090726 | 4/1993 |
| JP | 05090748 | 4/1993 |
| JP | 05090749 | 4/1993 |
| JP | 2002043737 | 2/2002 |
| JP | 2002117707 | 4/2002 |
| JP | 2005285960 | 10/2005 |
| JP | 2006080227 | 3/2006 |
| JP | 2007208200 | 8/2007 |
| JP | 2010153549 | 7/2010 |
| JP | 2011169791 | 9/2011 |
| WO | 2007076819 | 7/2007 |
| WO | 2011064107 | 6/2011 |
| WO | 2011077778 | 6/2011 |
| WO | 2011136236 | 11/2011 |
| WO | 2014031567 | 2/2014 |

OTHER PUBLICATIONS

"Derwent-Acc-No: 2010-J09039," corresponds to JP-201 0-153549A (1984).
"DRAGONtape DT6 Data Sheet," Sep. 2007 (4 pages).
"DRAGONtape Product Information Bulletin," OSRAM Sylvania, 2007, 2 pages.
"DRAGONtape Product Information Bulletin," OSRAM, Nov. 2005 (4 pages).
File History for U.S. Appl. No. 12/372,499 downloaded Nov. 13, 2019 (302 pages).
File History for U.S. Appl. No. 13/190,639 downloaded Nov. 13, 2019 (298 pages).
File History for U.S. Appl. No. 15/165,678 downloaded Dec. 4, 2019 (496 pages).
File History for U.S. Appl. No. 13/944,610 downloaded Nov. 13, 2019 (181 pages).
File History for U.S. Appl. No. 14/633,726 downloaded Nov. 13, 2019 (173 pages).
File History for U.S. Appl. No. 12/406,761 downloaded Nov. 13, 2019 (267 pages.).
File History for U.S. Appl. No. 13/791,228 downloaded Nov. 13, 2019 (153 pages).
File History for U.S. Appl. No. 14/216,182 downloaded Nov. 13, 2019 (184 pages).
File History for U.S. Appl. No. 12/419,879 downloaded Nov. 13, 2019 (259 pages).
File History for U.S. Appl. No. 14/506,251 downloaded Nov. 13, 2019 (308 pages).
File History for U.S. Appl. No. 15/675,938 downloaded Nov. 13, 2019 (296 pages).
File History for U.S. Appl. No. 13/158,149 downloaded Nov. 13, 2019 (384 pages).
File History for U.S. Appl. No. 12/043,424 downloaded Dec. 30, 2019 (160 pages).
File History for U.S. Appl. No. 13/411,322 downloaded Nov. 13, 2019 (173 pages).
File History for U.S. Appl. No. 14/015,679 downloaded Nov. 13, 2019 (241 pages).
File History for European Patent Application No. 13763341.8 downloaded Nov. 13, 2019 (194 pages).
File History for U.S. Appl. No. 13/592,090 downloaded Nov. 13, 2019 (520 pages).
File History for U.S. Appl. No. 16/450,366 downloaded Nov. 13, 2019 (199 pages).
"Flex Connectors User's Guide," OSRAM Sylvania, Oct. 2007 (6 pages).
"Fr406 High Performance Epoxy Laminate and Prepreg," Isola, 2006 (2 pages).
"Fr406: High Performance Epoxy Laminate and Prepreg," http://www.isola-group.com/en/products/name/details.shtl?13, Mar. 2008 (1 page).
"High Performance Epoxy Laminate and Prepreg," Isola, Mar. 2007 (3 pages).
"International Preliminary Report on Patentability," for PCT/US2013/055658, dated Mar. 5, 2015 (7 pages).
"International Search Report and Written Opinion," for PCT/US2013/055658, dated Jan. 15, 2014 (10 pages).
"Ipc-4101B: Specification for Base Materials for Rigid and Multilayer Printed Boards," Mar. 2006 (109 pages).
"Kapton Polyimide Film," DuPont Electronics, http://www2.dupont.com/Kapton/en_US/index.html, Feb. 2008 (9 pages).
"Linear Products," OSRAM Sylvania, http://www.sylvanaia.com/BusinessProducts/Innovations/LED+Systems/Linear/, 2004 (1 page).
"LINEARlight Flex & Power Flex LED Systems," OSRAM Sylvania, http://www/sylvania.com/AboutUs/Pressxpress/Innovation/LightingNews(US)/2007/USLi, Sep. 2007 (3 pages).
"LINEARlight Flex Topled, Flexible LED Strip," Osran Sylvania LED Systems Specification Guide (2007), p. 100.
"LINEARlight Power Flex, Flexible LED Strip," Osran Sylvania LED Systems Specification Guide, 2007, p. 96.
"LINEARlight Power Flex: Flexible High Light Output LED Modules," OSRAM SYLVANIA, Apr. 2008.

(56) References Cited

OTHER PUBLICATIONS

"LINEARlight Power Flex: LM10P Data Sheet," May 2007 (4 pages).
"Lm317l3-Terminal Adjustable Regulator," Texas Instruments Device Specification Brochure rev. Oct. 2014 (31 pages).
Murray, Cameron T. et al., "3M Thermally Conductive Tapes," 3M Electronic Markets Materials Division, Mar. 2004 (39 pages).
"NF2L757GRT-V1," Nichia Corporation Specifications for Warm White LED Brochure available at least as early as Jul. 19, 2017 (29 pages).
"NF2W757GRT-V1," Nichia Corporation Specifications for White LED brochure available at least as early as Jul. 19, 2017 (26 pages).
"NFSL757GT-V1," Nichia Corporation Specifications for Warm White LED Brochure available at least as early as Jul. 19, 2017 (22 pages).
"NFSW757GT," Nichia Corporation Specifications for White LED Brochure available at least as early as Jul. 19, 2017 (24 pages).
"Nichia Application Note," Oct. 31, 2003 (p. 5).
"Nud4001—High Current LED Driver," Semiconductor Components Industries, LLC http://onsemi.com, Jun. 2006 (8 pages).
O'malley, Kieran "Using the NUD4001 to Drive High Current LEDs," http;//onsemi.com, Feb. 2005 (4 pages).
"Product Information Bulletin HF2STick XB: Hi-Flux 2nd Generation Module," OSRAM Sylvania, Jan. 2008 (4 pages).
"Specifications for Nichia Chip Type Warm White LED, Model: NS6L083T," Nichia Corporation, Jun. 2006, 3 pages.
"Specifications for Nichia Chip Type White LED Model: NS6W083AT," NICHIA Corporation, No. STSE-CC7134, <Cat.No.070706>, date unknown (14 pages).
"TechniMask ISR 1000 Series," Technic, Inc., http://www.technic.com/pwb/solderisr1000.htm, 2003 (1 page).
"Thermal Management for LED Applications Solutions Guide," The Bergquist Company, date unknown (6 pages).
"T-lam System—Thermally Conductive Circuit Board Materials," http://www.lairdtech.com/pages/products/T-Lam-System.asp, Feb. 2008 (7 pages).

* cited by examiner

SOLID STATE LIGHTING CIRCUIT WITH CURRENT BIAS AND METHOD OF CONTROLLING THEREOF

This application claims the benefit of U.S. Provisional Application No. 62/738,728, filed Sep. 28, 2018, the content of which is herein incorporated by reference in its entirety.

FIELD

Embodiments herein relate to solid-state lighting circuits.

BACKGROUND

The term solid-state lighting (SSL) refers to a type of lighting in which light is emitted from a semiconductor, rather than from an electrical filament (as in the case of traditional incandescent light bulbs), a plasma (as is in the case of arc lamps such as fluorescent lamps) or a gas. Examples of SSL emitters include light-emitting diodes (LEDs), organic light-emitting diodes (OLEDs) or polymer light-emitting diodes (PLEDs) as sources of illumination rather than electrical filaments, plasma (e.g., used in arc lamps such as fluorescent lamps) or gas. Compared to incandescent lighting, SSL creates visible light with reduced heat generation or parasitic energy dissipation. In addition, its solid-state nature provides for greater resistance to shock, vibration and wear, thereby increasing its lifespan significantly.

SUMMARY

In an embodiment, a solid-state lighting circuit is included. The circuit can include a first plurality of emitters configured to output light of a first color and a second plurality of emitters configured to output light of a second color. The first plurality of emitters and the second plurality of emitters can be configured to be operably connected to a constant current power supply. The circuit can include a current limiting circuit and at least one biasing resistor operably connected to the first plurality of emitters and the current limiting circuit. The current limiting circuit can be configured to operably connect the constant current power supply to the first plurality of emitters. Current can be biased toward the first plurality of emitters until a preselected current limit is reached for the first plurality of emitters, such that the first plurality of emitters outputs the light of the first color. When current is provided by the constant current power supply that is at or above the preselected current limit, current can pass through the second plurality of emitters such that the second plurality of emitters outputs the light of the second color.

In an embodiment, a solid-state lighting circuit is included. The circuit can include a power supply path and a power return path. The circuit can include a first emitter branch comprising a current limiting circuit operably connected to a first plurality of emitters in series and at least one resistor, the first plurality of emitters configured to output light of a first color. The circuit can include a second emitter branch comprising a second plurality of emitters in series, the second plurality of emitters configured to output light of a second color. The first emitter branch can be operably connected to the power supply path and the power return path. The second emitter branch can be operably connected to the power supply path and the power return path in parallel with the first emitter branch. Current provided by the power supply path can be biased toward the first emitter branch until a preselected current limit is reached for the first plurality of emitters, such that the first plurality of emitters outputs the light of the first color. When current is provided by the power supply path that is at or above the preselected current limit, current can pass through the second emitter branch such that the second plurality of emitters outputs the light of the second color.

In an embodiment, a solid-state lighting device is included. The device can includea circuit board and a solid-state lighting circuit disposed on the circuit board. The solid-state lighting circuit can include a first plurality of emitters configured to output light of a first color and a second plurality of emitters configured to output light of a second color. The first plurality of emitters and the second plurality of emitters can be configured to be operably connected to a constant current power supply. The circuit can include a current limiting circuit and at least one biasing resistor operably connected to the first plurality of emitters and the current limiting circuit. The current limiting circuit can be configured to operably connect the constant current power supply to the first plurality of emitters. Current can be biased toward the first plurality of emitters until a preselected current limit is reached for the first plurality of emitters, such that the first plurality of emitters outputs the light of the first color. When current is provided by the constant current power supply that is at or above the preselected current limit, current can pass through the second plurality of emitters such that the second plurality of emitters outputs the light of the second color.

In an embodiment, a method for changing the net color output of a solid-state lighting device is included. The method can include receiving an input current and emitting light of a first color from a first plurality of emitters in response to the input current, the first plurality of emitters operably connected to a current limiting circuit and at least one biasing resistor that provides a preselected current limit for the first plurality of emitters. The method can further include biasing the input current toward the first plurality of emitters until the preselected current limit is reached, such that the first plurality of emitters outputs the light of the first color. The method can further include emitting light of a second color from a second plurality of emitters in response to the input current when the preselected current limit for the first plurality of emitters is met or exceeded, the second color being different than the first color.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures (FIGS.), in which.

Figure 1:
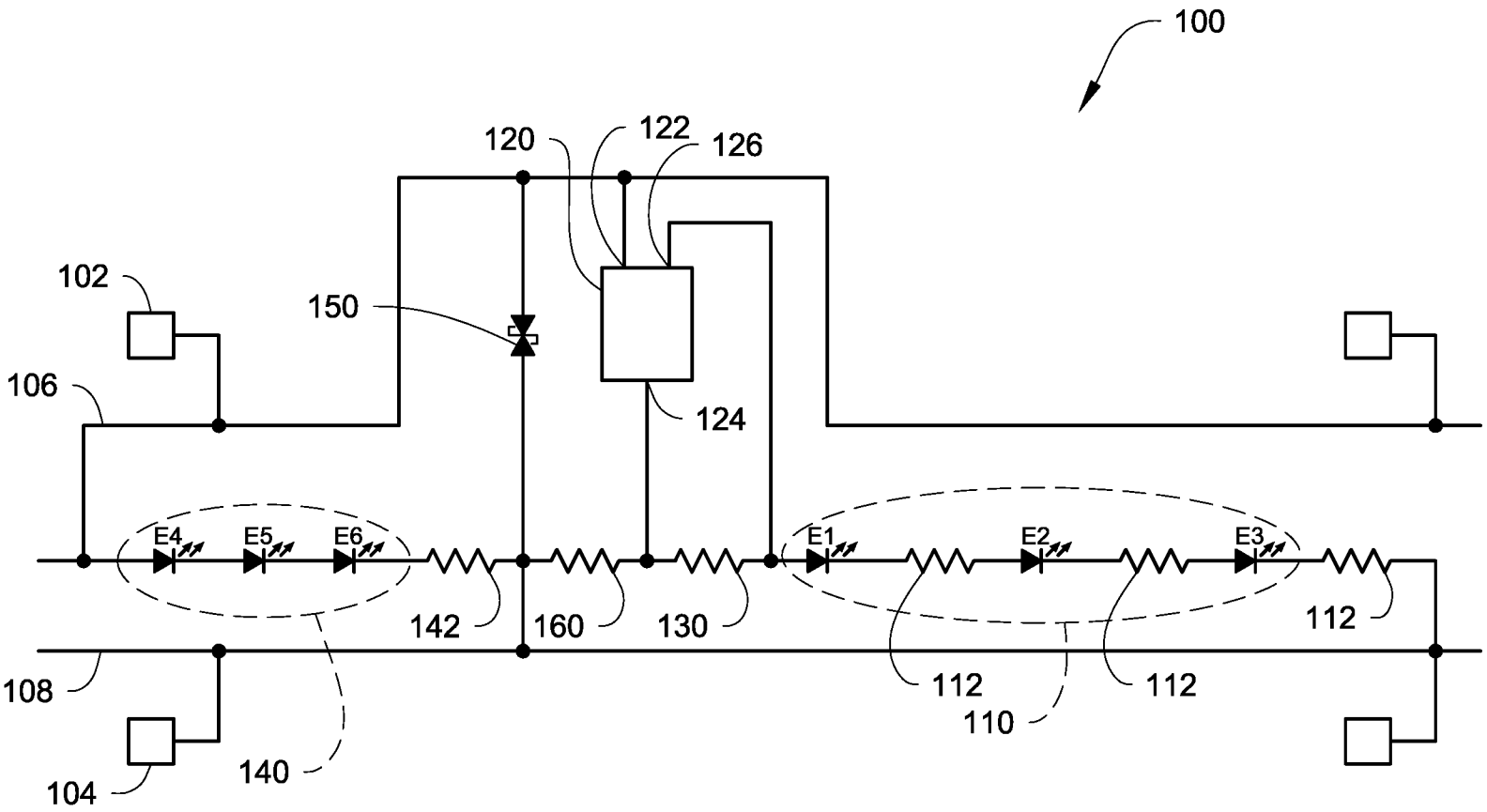
FIG. 1 is a schematic view of a solid-state lighting circuit for powering and controlling multiple SSL emitters in accordance with various embodiments herein.

While embodiments are susceptible to various modifications and alternative forms, specifics thereof have been shown by way of example and drawings, and will be described in detail. It should be understood, however, that the scope herein is not limited to the particular aspects described. On the contrary, the intention is to cover modifications, equivalents, and alternatives falling within the spirit and scope herein.

DETAILED DESCRIPTION

The present disclosure is generally related to solid-state lighting (SSL) circuits, devices including the same, and related methods. Examples of SSL devices herein include, but are not limited to, lighting fixtures, light bulbs, lighting strips, and/or components thereof. According to various embodiments, SSL lighting devices are provided that contain one or more SSL emitters. Generally speaking, the SSL emitters produce light when provided with electrical power meeting certain voltage and current characteristics. According to various embodiments, SSL emitters herein specifically include light emitting diodes (LEDs). However, other types of SSL emitters can also be used. Accordingly, while various embodiments are described herein as using LEDs, it will be appreciated that other types of SSL emitters may be used instead of, or in addition to, LEDs in various implementations.

According to various embodiments, a lighting device with multiple LEDs (or other SSL emitters) can be controlled with a constant current power supply (and in various embodiments a single constant current power supply). As the supply current from the constant current power supply increases, light from the lighting device changes from a first color with increasing brightness to a blended combination of the first color and a second color. In some embodiments, as the supply current is further increased, the light changes to a blended combination of the first and second colors in which the second color increases in brightness, thereby dominating the first color.

In various embodiments, an LED lighting device includes a first group of LEDs (one or more) and a second group of LEDs (one or more). The lighting device includes a current limiting circuit and one or more biasing resistors configured so that current provided by a constant current power supply is preferred by the first group of LEDs until a current limit for the first group of LEDs is met. The second group of LEDs starts to take available supply current around the time that the current limit is met. According to various embodiments, the second group of LEDs begins to take available supply current based on a voltage stack of the first group of LEDs along with the biasing resistors with the current limiting circuit. When the first group of LEDs reaches a maximum set current limit, the second group of LEDs takes all remaining increases in the supply current, thus making the second group of LEDs brighter than the first group of LEDs.

According to various embodiments, the first group of LEDs is configured to output light of a first color and the second group of LEDs is configured to output light of a second color (for example, a different color temperature). With the first and second groups of LEDs initially off, increasing a controlled supply current (for example, with a dimming control on the power supply) causes the first group of LEDs of the first color to turn on and then increase in brightness toward a maximum brightness. As the supply current increases further, the second group of LEDs of the second color begins to onset. In some cases, the first color may or may not continue to increase in brightness after the second group of LEDs turns on. As the supply current is further raised, the second color increases in brightness while the first color continues at a maximum brightness. Thus, according to various embodiments, the LEDs emit a first color that gives way to a brighter combined blending of the first and second colors.

Various embodiments incorporate advantageous techniques for powering and operating one or more LEDs (or other SSL emitters). In some cases such techniques can result in lower costs for operating the LEDs. In some cases LEDs can be powered and operated with a driving circuit that is simpler than known driving circuits, having, for example, fewer active components and/or fewer components in general. According to various implementations, powering and/or operating one or more LEDs on a lighting device includes a dimming capability. As an example, various embodiments provide a lighting device with multiple LEDs. The brightness of different LEDs can be adjusted at different times using a single power supply. In various implementations, a single control, such as, for example, a single dimmer switch can be used to dim or brighten an LED lighting device by turning multiple LEDs on (or off) at different times. According to various embodiments, a single control can be used to change the color of the light from an LED lighting device. In some cases a single control (e.g., a single dimmable power supply) is used to transition the color as well as the brightness of the light generated by an LED lighting device.

As previously discussed, various embodiments are directed to solid-state lighting (SSL) devices that include one or more SSL emitters. Referring now to FIG. 1, a schematic view of a solid-state lighting circuit 100 for powering and controlling multiple SSL emitters is shown in accordance with various embodiments. The circuit 100 is configured to be operably connected to a power supply. According to various embodiments, the SSL circuit 100 is configured to be operably connected to a constant current power supply. In various embodiments, the circuit 100 includes first and second connection pads 102, 104 to which electrical leads can be soldered for operably connecting the power supply. The first and second connection pads 102, 104 are respectively connected to a power supply path 106 and a power return path 108. The power supply and return paths 106, 108, are also referred to herein as first and second power buses 106, 108. A transient voltage suppression element 150 (e.g., a TVS diode) is connected across the first and second power buses 106, 108 to protect the circuit 100 against voltage spikes from the power supply.

In various embodiments, the circuit 100 includes two or more emitter branches connected between the power supply and return paths. As depicted in FIG. 1, the circuit 100 has a first group 110 of solid-state lighting (SSL) emitters E1, E2, E3 that form a portion of a first emitter branch operably connected to the power supply path 106 and the power return path 108. The first group 110 of SSL emitters is operably connected in series with one or more ballast resistors 112. In this example the SSL circuit 100 also has a second emitter branch that includes a second group 140 of SSL emitters E4, E5, E6. The second emitter branch is operably connected to the power supply path 106 and the power return path 108 in parallel with the first emitter branch. According to various implementations, the second group 140 of emitters is operably connected in series with one or more ballast resistors 142. The second group 140 of emitters is configured to be operably connected to the power supply through the power supply path 106 and the power return path 108.

As shown in FIG. 1, the first emitter branch includes a current limiting circuit that, in various embodiments, includes a voltage regulator 120 and a feedback resistor 130. The voltage regulator has one or more input pins 122, one or more output pins 124, and an adjustment pin 126. The input pin 122 is operably connected to the power supply path 106. The feedback resistor 130 is operably connected between the voltage regulator's output and adjustment pins 124, 126. The feedback resistor 130 also operably connects the current limiting circuit to the first group 110 of SSL emitters. Accordingly, the current limiting circuit is configured to operably connect a power supply to the first group 110 of emitters, for example, via the first pad 102 and the power supply path 106.

According to various embodiments, the SSL circuit 100 includes at least two biasing resistors for adjusting relative voltage levels in the circuit. In various implementations, the feedback resistor 130 functions as a first biasing resistor. FIG. 1 illustrates a bleed resistor 160 that is operably connected between the power return path 108 (and/or ground) and the current limiting circuit at the output 124 of the voltage regulator 120.

According to various implementations, the SSL circuit 100 is configured to be powered by a constant current power supply connected to the pads 102, 104. The power supply can be adjusted using a dimming control such as, for example, a dimming switch. Actuating the dimming control adjusts the level of current supplied to the SSL circuit 100 by the constant current power supply.

According to various embodiments the first group 110 of emitters produces a first color of light and the second group 140 of emitters produces a second color of light that is different from the first color. As an example, in various implementations the first color is a warm white color and the second color is a white color. As discussed herein, assigning a different color temperature to each group of emitters can in various embodiments provide the circuit 100 with the ability to change light output in terms of both brightness and color temperature. According to various embodiments, the SSL circuit 100 changes the overall light output and/or combined visual impression of the circuit's light output by changing which of the emitter groups is active and/or by changing the intensity or brightness of the light generated by one or both of the first and second emitter groups 110, 140.

Figure 2:
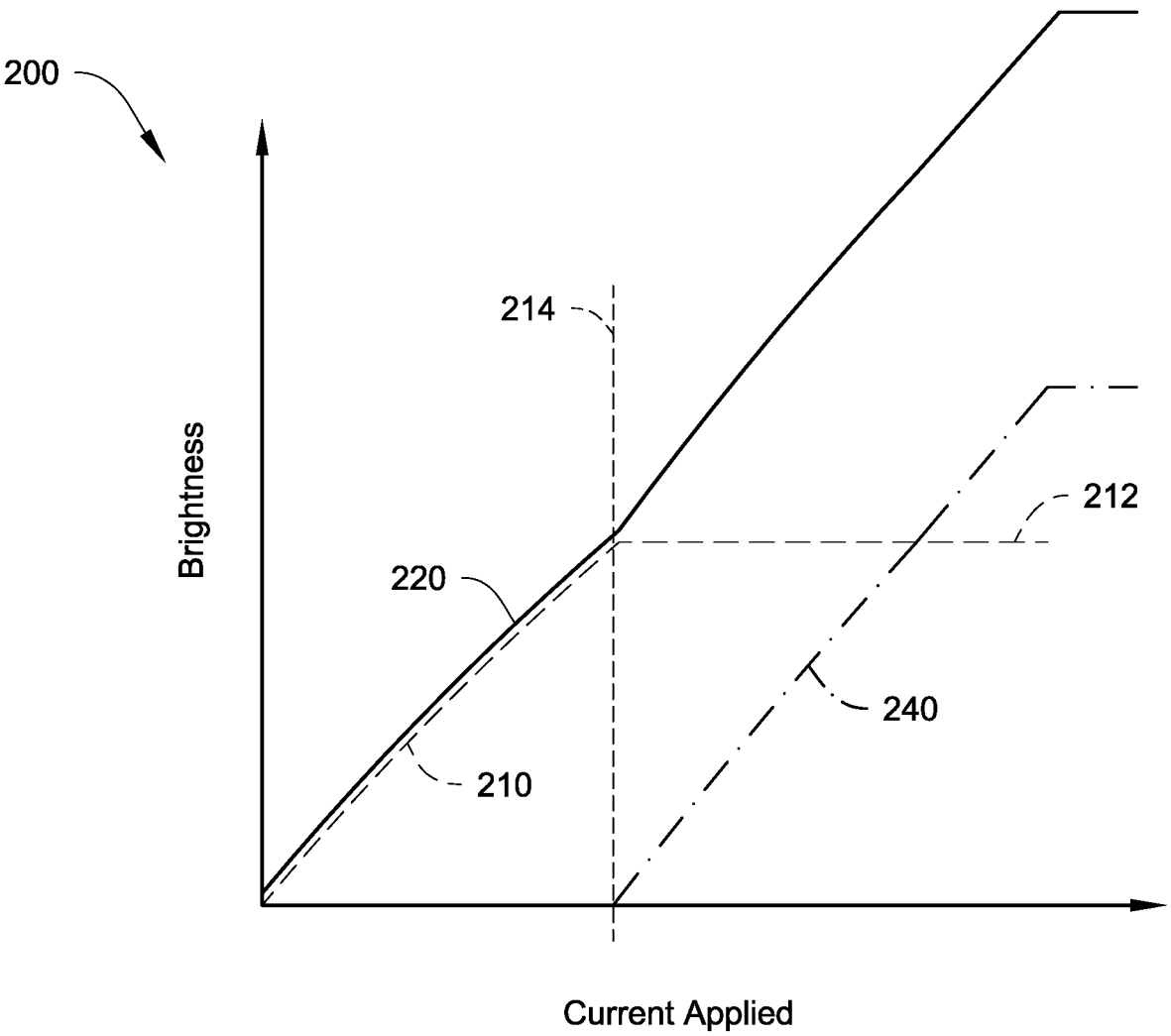
FIG. 2 is a graph illustrating relative changes in brightness versus current applied for multiple SSL emitters in accordance with various embodiments herein.

Operation of the solid-state lighting circuit 100 according to various embodiments will now be described, with additional reference to FIG. 2, which is a graph 200 illustrating relative changes in brightness versus current applied for multiple SSL emitters in accordance with various embodiments herein.

According to various embodiments, the SSL circuit 100 operates to direct current flow from a constant current power supply (e.g., via the power supply path 106) to one or both of the first and second groups 110, 140 of emitters. In various implementations, a preselected current limit 214 is set for the first group 110 of emitters by the current limiting circuit and the biasing resistors, including the voltage regulator 120, the feedback resistor 130, and the bleed resistor 160 (in some embodiment 10K or greater ohms). Many different preselected current limits 214 can be used depending on the current and wattage of the emitters used. By way of example, exemplary current limits using 0.5 and 1 watt emitters can include about 20, 30, 40, 50, 60, 70, 80, 90, 100, 110, 120, or 125 mA, or an amount that falls within a range between any of the foregoing.

As current is received at the power supply path 106 from the constant current power source, the current is biased toward the first group of emitters until the preselected current limit is reached. As shown in FIG. 2, in some implementations the current biasing also results in the brightness 210 of the first group of emitters increasing to a maximum brightness 212 that corresponds to the preselected current limit 214. In various implementations the first group 110 of emitters is configured to output a first color of light, and thus the maximum brightness 212 corresponds to a maximum brightness of the first color generated by the solid-state lighting circuit 100.

According to various embodiments, the second group 140 of emitters remains off at current levels below the preselected current limit 214, thus allowing the combined light output 220 shown in FIG. 2, up until the preselected current limit, to be light of the first color. As current provided by the constant current power supply rises to the preselected current limit 214 or above, the current begins passing through the second emitter branch and the second group 140 of emitters. As the current continues to increase above the preselected current limit, the additional increases in current are routed to the second group 140 of emitters by the circuit 100. Thus, the increasing level of current above the preselected current limit also results in an increasing brightness 240 of the second group 140 of emitters, as shown in FIG. 2. In various embodiments, the second group 140 of emitters is configured to output a second color of light. Thus, as the output from the second group 140 of emitters becomes brighter as current increases above the preselected current limit, the combined light output of the SSL circuit 100 turns from the first color to a blend of the first and second colors, with the second color increasingly dominating the first color as current increases.

According to various implementations, such as the one illustrated in FIG. 1, the emitters in the first and second groups 110, 140 are light emitting diodes (LEDs). In various embodiments, other types of SSL emitters may be used instead of or in addition to LEDs. Regardless of the type of SSL emitter used, in various embodiments the emitters as part of the circuit 100 can be incorporated into a solid-state lighting (SSL) device.

Figure 3:
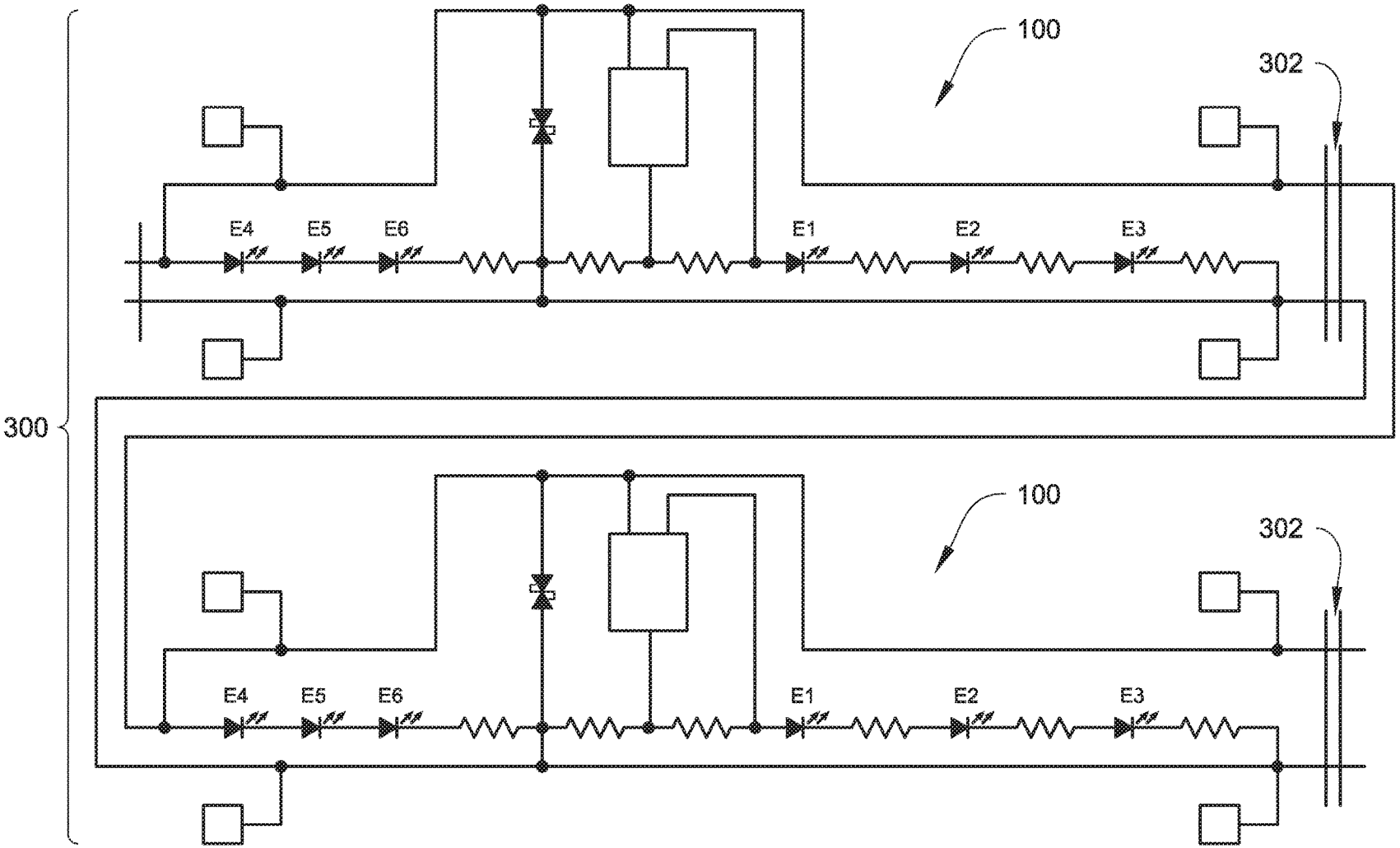
FIG. 3 is a schematic view of a solid-state lighting circuit for powering and controlling multiple SSL emitters in accordance with various embodiments herein.

In various cases the SSL devices can include two or more SSL circuits 100 in series. In some embodiments, an SSL device herein can include 10, 20, 30, 50, 100, 200, 500 or more SSL circuits 100 in series. Referring now to FIG. 3, a schematic view of circuit 300 for powering and controlling multiple SSL emitters is shown in accordance with various embodiments herein. As shown in the figure, the circuit 300 includes two instances of the SSL circuit 100, illustrated in FIG. 1, connected in series. Manufacturing multiple SSL circuits in series can be useful in various cases. For example, multiple SSL circuits in series can enable manufacturing of SSL elements and fixtures with varying numbers of circuits and emitters. For example, the SSL circuits on circuit boards (such as flexible circuit boards) can be shipped to a lighting fixture manufacturer (or other manufacturer) and then cut to the proper size for a particular application by cutting the circuit board at a predefined separation juncture 302, which preserves functionality of the circuit on either side of the separation juncture 302. In some cases, multiple instances of SSL circuits can be manufactured in the form of a long strip and wound onto a tape reel, which can be useful for building SSL elements and fixtures having any number of circuits. A desired length of the strip (corresponding to a specific number of SSL circuits) can be taken off the reel and then cut to length before mounting in a lighting fixture or other device.

Figure 4:
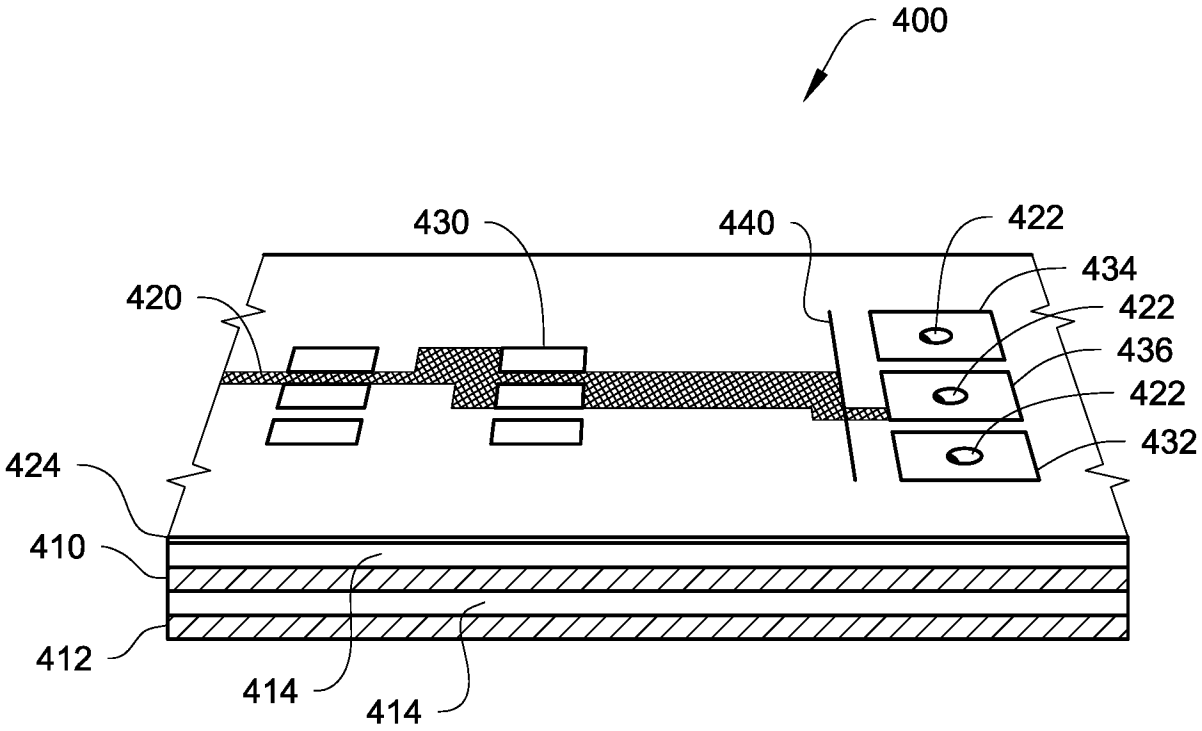
FIG. 4 is a partial perspective cut-away view of a circuit board for a solid-state lighting device in accordance with various embodiments herein.

As discussed herein, in various embodiments, the SSL circuit 100 shown in FIG. 1 can be implemented as a solid-state lighting device that includes a number of electrical components mounted to a printed circuit board containing conductive traces that electrically connect the various components. Referring now to FIG. 4, a partial perspective cut-away view of a circuit board 400 for an SSL device is shown in accordance with various embodiments herein. The SSL circuit board 400 is depicted in a partial, high-level view that is not necessarily to scale and that for clarity omits some details that would ordinarily be visible.

As illustrated in FIG. 4, the circuit board 400 has connection pads according to various embodiments. In this implementation, the circuit board 400 has two electrically conductive layers 410, 412 with an electrically insulating material 414 sandwiched in between. In various cases the electrically conductive layers can optionally be 2 oz. copper to carry high currents associated with SSL high power emitters. However, it will be appreciated that many different weights of conductive layers and many different conductive materials (such as aluminum) are contemplated herein. In some cases the inner insulating layer 414 is a 0.012 inch thick fiberglass composite material. However, it will be appreciated that many different thicknesses of an insulating layer and many different insulating materials are contemplated herein. Circuit paths of various designs can be etched into the top and bottom conductive layers 410, 412 to produce conductive paths 420 for the circuit. Plated through holes 422 can be added to join conductive paths or pads etched from the conductive layers. Additional thin layers of non-conductive solder repelling material 424 (solder masks) can be added to the top and bottom of the board 400 to restrict the movement of solder and protect the circuit paths. The solder mask 424 is interrupted to expose conductive pads 430 for mounting electronic components, as well as pads 432, 434, and 436 used for interconnections (circuit board to circuit board) or for power supply input, control input, or circuit to circuit interconnections. On top of the solder mask 424, visible markings 440 may be printed consisting of text and other circuit markings.

In some embodiments, two pads are provided for connecting a power supply. In various embodiments, the first pad 432 is configured to operably connect to and receive a supply signal from the power supply and pass the supply onto a power supply path. In some cases the supply signal may be a DC voltage or current. In some cases the supply signal may be an AC voltage or current that is then rectified to provide a positive signal for the circuit board 400. According to various embodiments, the power supply is a constant current power supply that supplies the first pad 432 with a regulated, constant current supply. The second pad 434 is the return path for the power supply. Additional pads 436 may be used for control signal input or output in various embodiments. While FIG. 4 show a particular number of layers, it will be appreciated that this is only shown by way of example and that embodiments herein can include a greater or lesser number of layers.

Figure 5:
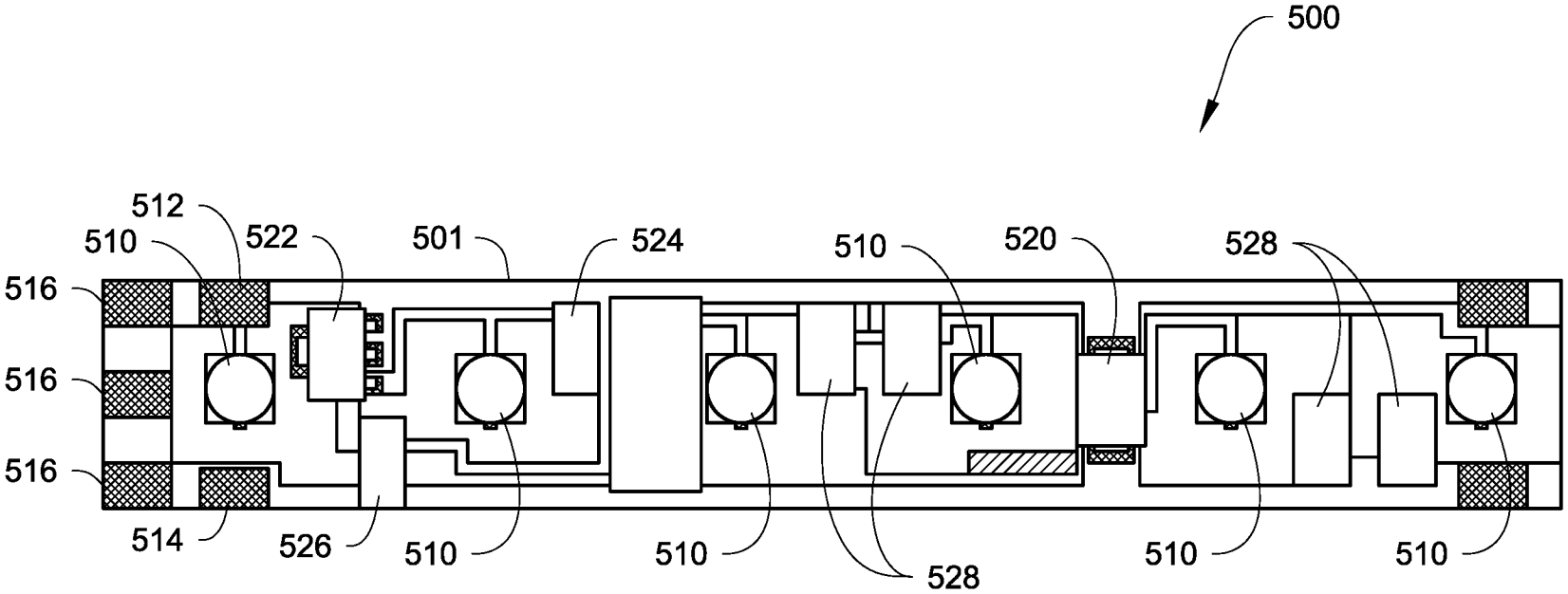
FIG. 5 is a top view of a solid-state lighting device in accordance with various embodiments herein.

Referring now to FIG. 5, a top view of a solid-state lighting device 500 including several electrical components mounted to a circuit board 501 is shown in accordance with various embodiments herein. In various implementations the SSL device 500 includes an SSL circuit, such as the circuit 100 illustrated in FIG. 1. In the example depicted in FIG. 5, the device 500 includes the printed circuit board 501 along with six SSL emitters 510 mounted on the board. According to various embodiments, the SSL emitters 510 are divided into a first group that outputs a first color of light and a second group that outputs a second color of light. The device also includes two conductive pads 512, 514 used to operably connect the device 500 to a power supply for supplying power to the circuit.

The SSL device 500 also includes a transient voltage suppression (TVS) device 520 that is operably connected to the power pads to prevent damage from high voltage transients from the power supply. One example of a TVS device is a Fairchild Semiconductor SMBJ36CA TVS diode, however, many other TVS devices are contemplated herein. In addition, a current limiting circuit including a regulator 522 and a feedback resistor 524 is provided, along with a biasing resistor 526 and multiple ballast resistors 528. As previously discussed, in various embodiments the current limiting circuit and biasing resistor(s) can be used to set a preselected current limit for one group of emitters.

Additional pads 516 can be used in some cases to operably connect the SSL device 500 to another circuit or assembly. According to various embodiments, another SSL device (e.g., an identical SSL device 500 or another) can be operably connected to the SSL device 500 using the additional pads 516. As an example, two SSL devices, each incorporating an SSL circuit 100 as shown in FIG. 3, can be connected in this manner. The devices can be connected in an overlapping or non-overlapping manner.

Figure 6:
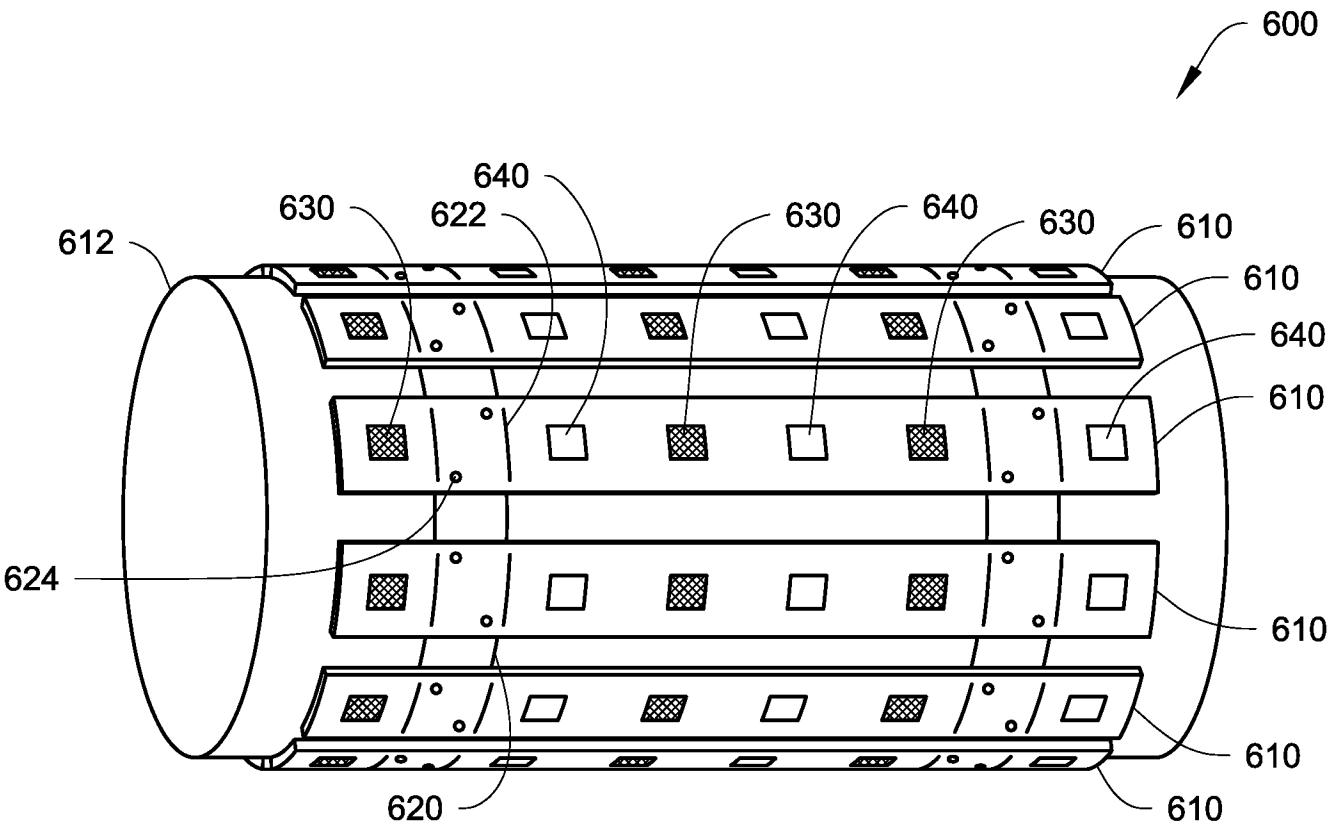
FIG. 6 is a perspective view of a cylindrical assembly of multiple solid-state lighting devices in accordance with various embodiments herein.

According to some embodiments, many types of consumer, commercial, and industrial products can incorporate solid-state lighting devices in various configurations to provide illumination. Examples of products that can include SSL devices according to various embodiments include, but are not limited to, light bulbs, lamps, lanterns, flashlights, decorative lighting, commercial lighting fixtures, displays, and other products of various sizes, configurations and uses. Referring now to FIG. 6, a perspective view of a cylindrical assembly 600 of multiple solid-state lighting devices 610 is shown in accordance with various embodiments herein. As shown in this example, the SSL devices 610 are arranged as an array of circuit boards wrapping around a cylindrical heat sink 612. The devices 610 are interconnected by a conductive device 620 which supplies power through pads 622, 624 on each device's circuit board. According to some embodiments, each SSL device 610 shares power and functions similarly. As an example, in various implementations a single constant current power source can be operably connected to the conductive device 620 and thus power and control the operation of each SSL device 610.

In various implementations, one or more of the SSL devices 610 incorporate the solid-state lighting circuit 100 shown and described with respect to FIG. 1. In some cases the assembly 600 may include several identical SSL devices, and in some cases the assembly 600 may include differently configured SSL devices. According to various embodiments, each solid-state lighting device 610 includes a first group of emitters 630 that emits a first color of light and a second group of emitters 640 that emits a second color of light. In some cases, a current that is lower than a preselected threshold will cause the first group of emitters 630 to turn on. As the current rises above the preselected threshold, the second group of emitters 640 turns on according to various embodiments. As shown in FIG. 6, in the depicted example the SSL devices 610 are powered with a current that is below the preselected threshold for the devices 610, and thus only the first group of emitters 630 are illuminated.

Figure 7:
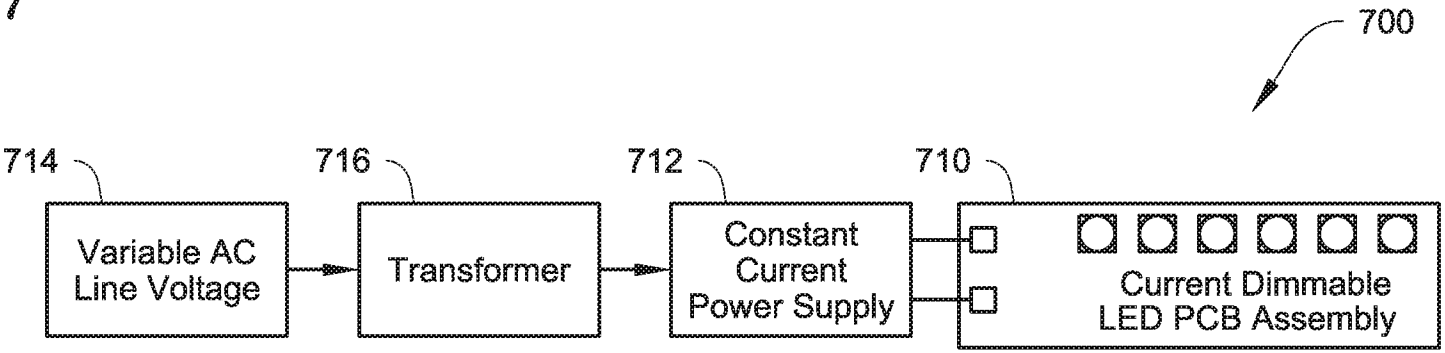
FIG. 7 is a block diagram of an LED lighting system for use with an alternating current input in accordance with various embodiments herein.

As discussed herein, various embodiments are operably configured to be powered by a constant current power supply. In some cases a solid-state lighting device can be enabled to operate using a DC power supply. In some cases a SSL device can be enabled to operate using an AC power supply. Referring now to FIG. 7, a block diagram of an LED lighting system 700 for use with an AC power input is shown in accordance with various embodiments herein. The system 700 includes a current dimmable SSL device 710 that incorporates an SSL circuit similar to the circuit 100 shown in FIG. 1 in some cases. The SSL device is operably connected to a constant current power supply 712. The power supply is operably connected to a variable AC line voltage source 714 through a transformer 716. The transformer 716 can in some cases be a magnetic transformer, an electronic transformer, or a regenerator.

In various embodiments, the SSL device 710 or another part of the system 700 includes a full-wave or half-wave rectifier that rectifies the AC power signal before it reaches the SSL emitters on the solid-state lighting device 710. In various embodiments a DC power source may be used to power the SSL device 710, in which case the rectifier and likely the transformer 716 would not be needed.

Figure 8:
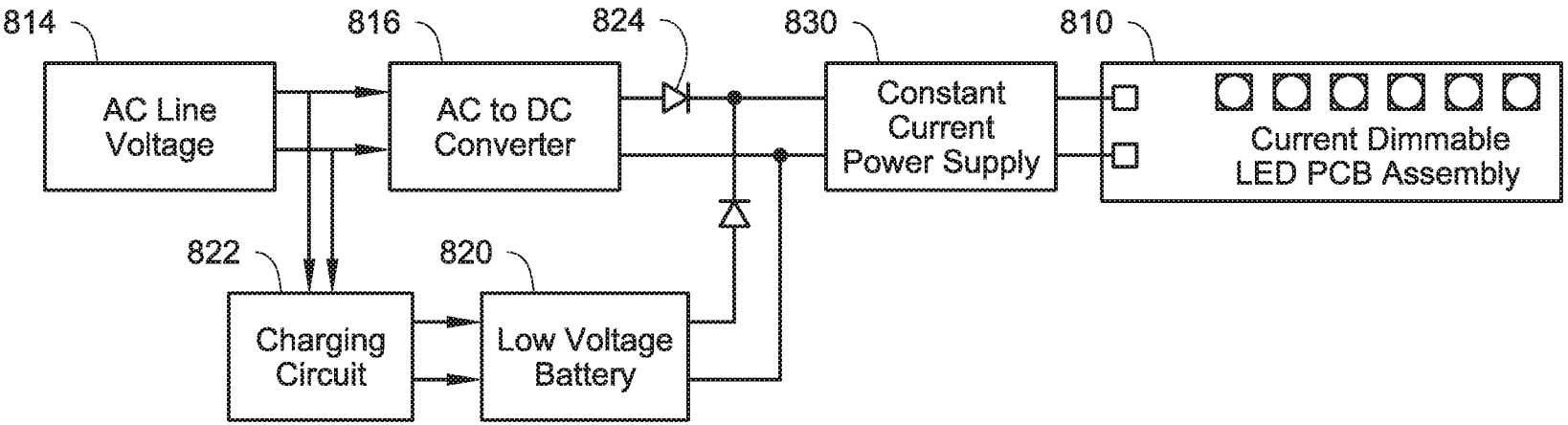
FIG. 8 is a block diagram of a battery backed up emergency/safety light system in accordance with various embodiments herein.

Referring now to FIG. 8, a block diagram of a battery backed up emergency/safety light system 800 is shown in accordance with various embodiments herein. In this example primary power is provided by an AC to DC power supply converter 816 operating from a high voltage AC source 814. In some cases back up power can be provided by a low voltage battery 820 charged from the primary circuit with a charging circuit 822 or by any type of emergency supply. In some cases diodes 824 are used to prevent backwards current flow into either source.

According to some embodiments, in the event that the primary power source 814 is unavailable, the SSL circuit 810 will turn on a first group of emitters that generate a first color of light using backup power stored in the battery 820. In some cases the circuit 810 will also turn on a second group of emitters that output a second color of light if the supply from the backup power source 820 enables a constant current from the power supply 830 that exceeds a preselected threshold current for the first group of emitters.

Methods

Various methods are included herein. For example, methods herein can include a method of manufacturing an SSL device, a method of changing the net output and/or color output of a solid-state lighting device, and the like. Referring now to FIGS. 1-8 as a whole, various embodiments provide a method for changing the net color output of a solid-state lighting fixture. In some cases the solid-state lighting (SSL) fixture includes one or more solid-state lighting devices that incorporate a SSL circuit such as, for example, the SSL circuit 100 shown in FIG. 1. The method includes, among other possible steps, receiving an input current and emitting light of a first color from a first group of emitters in response to the input current. The first group of emitters is operably connected to a current limiting circuit and at least two biasing resistors. The current limiting circuit and biasing resistors provide a preselected current limit for the first group of emitters. The method further includes biasing the input current toward the first group of emitters until the preselected current limit is reached. This results in the first group of emitters outputting light of the first color. In some cases the method also includes emitting light of a second color from a second group of emitters. The second group of emitters emit light of the second color in response to the input current when the preselected current limit for the first group of emitters is met or exceeded. According to various embodiments, the second color emitted by the second group of emitters is different than the first color emitted by the first group of emitters.

In various embodiments the method also includes increasing the brightness of the light of the first color as the input current increases up to a preselected current limit. After the preselected current limit is reached, the method can also include maintaining a maximum brightness of the light of the first color as the input current increases above the preselected current limit, according to some implementations. In some cases the method includes increasing a brightness of the light of the second color as the input current increases, after the preselected current limit is reached.

Emitters

As described herein, embodiments incorporate the use of one or more solid-state lighting (SSL) emitters. According to various embodiments, SSL emitters are implemented as light emitting diodes (LEDs). Other types of SSL emitters may also be used. Accordingly, while various embodiments are described herein as using LEDs, it will be appreciated that other types of SSL emitters may be used instead of, or in addition to, LEDs in various implementations.

As shown in FIG. 1, the first group of emitters 110 includes three emitters E1, E2, E3 in series and the second group of emitters 140 includes three additional emitters E4, E5, E6 in series. Of course it should be appreciated that each group 110, 140 may in some cases include a higher or lower number of emitters depending upon the particular implementation and factors such as the desired type and amount of light output, the performance characteristics of the emitters, and the like.

According to some embodiments, as the constant current fed to the first and second groups of emitters is increased, the color mix of the turned on emitters can change. In some cases specific emitters of varying colors can be positioned in emitter strings so the controlled sequence would turn on emitters so to precisely control color mixes above and below the preselected current limit. This is extremely beneficial in applications where it is desirable to cast a warm (reddish) light color as the lights begin to come on, transitioning to a cooler brighter (bluish) light at full intensity. It is also beneficial when special lighting effects, such as the transition of a primary light color to blended light color is desired (example: green plus red produces yellow).

With continuing reference to FIG. 1, in some cases the first and second groups of emitters can be light emitting diodes available from Nichia Corporation of Tokushima, Japan. According to various embodiments, the first group 110 of emitters emit a warm white light having a color temperature of about 2000K to about 3000K. In some cases the second group 140 of emitters emit a white light having a color temperature of about 4000K to about 5000K.

According to some embodiments the light produced by each individual emitter within the first and second groups is nominally the same color temperature as the other emitters with each respective group. In some embodiments each of the emitters within a particular group may be rated by the manufacturer as having a distinct and different color temperature, but may still be considered as being within an acceptable temperature range such that the combined light generated by a particular group of LEDs has a desired appearance. In some embodiments, emitters having a color temperature within a specific flux bin can be selected for each of the emitters of an SSL device individually. As one possible example, in some cases a first group of three LEDs can generally provide a warm white light but individually have separate color temperatures, such as 2000K, 2700K, and 3000K according to specific flux bins provided by the manufacturer. In a similar manner, a second group of three LEDs can output a white color of light, but individually may have separate color temperatures, such as, for example, 4000K, 4500K, and 5000K. Of course other color temperatures and mixtures of emitters have various color temperatures can be provided in various embodiments depending upon the desired characteristics of the light to be generated by the emitters.

Other Components

As described herein, various embodiments provide a current limiting circuit that includes a voltage regulator with a feedback resistor placed across the regulator's output and adjustment pins in order to provide a regulated constant current to the first group of emitters. See FIG. 1 for example. Various voltage regulators can be used for the current limiting circuit. One possible example of a voltage regulator is the generic model LM317 voltage regulator. In some cases, SSL circuits here can use Texas Instruments' model LM317L 3-Terminal Adjustable Regulator. Other examples of regulators are explicitly contemplated herein.

According to various embodiments, a solid-state lighting circuit is operably connected to a dimmable constant current power source.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A solid-state lighting circuit, comprising:

a first plurality of emitters configured to output light of a first color;

a second plurality of emitters configured to output light of a second color;

wherein the first plurality of emitters and the second plurality of emitters are configured to be operably connected to a constant current power supply;

a current limiting circuit;

at least one biasing resistor operably connected to the first plurality of emitters and the current limiting circuit;

wherein the current limiting circuit is configured to operably connect the constant current power supply to the first plurality of emitters;

wherein current in the solid-state lighting circuit as provided by the constant current power supply is biased toward the first plurality of emitters until a preselected current limit is reached for the first plurality of emitters, such that the first plurality of emitters outputs the light of the first color; and wherein when current that is provided by the constant current power supply is at or above the preselected current limit, current passes through the second plurality of emitters such that the second plurality of emitters outputs the light of the second color.

2. The solid-state lighting circuit of claim 1, wherein the current limiting circuit comprises a voltage regulator.

3. The solid-state lighting circuit of claim 1, wherein the first plurality of emitters outputs the light of the first color at a brightness that increases as the current provided by the constant current power supply increases.

4. The solid-state lighting circuit of claim 1, wherein the first plurality of emitters outputs the light of the first color at a maximum brightness after the preselected current limit is reached.

5. The solid-state lighting circuit of claim 1, wherein the second plurality of emitters outputs the light of the second color at a brightness that increases as the current provided by the constant current power supply increases above the preselected current limit.

6. The solid-state lighting circuit of claim 1, wherein the first plurality of emitters and the second plurality of emitters are mounted to a circuit board in alternating order.

7. The solid-state lighting circuit of claim 1, wherein the first plurality of emitters comprises a first color temperature and the second plurality of emitters comprises a second color temperature, wherein the second color temperature is higher than the first color temperature.

8. The solid-state lighting circuit of claim 1, wherein the first plurality of emitters is configured to output light of a first plurality of colors and the second plurality of emitters is configured to output light of a second plurality of colors, wherein an average color temperature of the second plurality of emitters is higher than an average color temperature of the first plurality of emitters.

9. The solid-state lighting circuit of claim 1, wherein the first and second pluralities of emitters are light emitting diodes.

10. The solid-state lighting circuit of claim 1, comprising at least two biasing resistors operably connected to the first plurality of emitters and the current limiting circuit.

11. A solid-state lighting circuit, comprising:

a power supply path and a power return path;

a first emitter branch comprising a current limiting circuit operably connected to a first plurality of emitters in series and at least one resistor, the first plurality of emitters configured to output light of a first color;

a second emitter branch comprising a second plurality of emitters in series, the second plurality of emitters configured to output light of a second color;

wherein the first emitter branch is operably connected to the power supply path and the power return path; and wherein the second emitter branch is operably connected to the power supply path and the power return path in parallel with the first emitter branch;

wherein current in the solid-state lighting circuit provided by the power supply path is biased toward the first emitter branch until a preselected current limit is reached for the first plurality of emitters, such that the first plurality of emitters outputs the light of the first color; and wherein when current that is provided by the power supply path is at or above the preselected current limit, current passes through the second emitter branch such that the second plurality of emitters outputs the light of the second color.

12. The solid-state lighting circuit of claim 11, wherein the current limiting circuit comprises a voltage regulator.

13. The solid-state lighting circuit of claim 11, wherein the first plurality of emitters outputs the light of the first color at a brightness that increases as the current provided by the power supply path increases.

14. The solid-state lighting circuit of claim 11, wherein the first plurality of emitters outputs the light of the first color at a maximum brightness after the preselected current limit is reached.

15. The solid-state lighting circuit of claim 14, wherein the second plurality of emitters outputs the light of the second color at a brightness that increases as the current provided by the power supply path increases above the preselected current limit.

16. The solid-state lighting circuit of claim 11, wherein the first plurality of emitters comprises a first color temperature and the second plurality of emitters comprises a second color temperature, wherein the second color temperature is higher than the first color temperature.

17. The solid-state lighting circuit of claim 11, wherein the first and second pluralities of emitters are light emitting diodes.

18. A solid-state lighting device comprising, a circuit board, and a solid-state lighting circuit disposed on the circuit board, the solid-state lighting circuit comprising a first plurality of emitters configured to output light of a first color;

a second plurality of emitters configured to output light of a second color;

wherein the first plurality of emitters and the second plurality of emitters are configured to be operably connected to a constant current power supply;

a current limiting circuit;

at least one biasing resistor operably connected to the first plurality of emitters and the current limiting circuit;

wherein the current limiting circuit is configured to operably connect the constant current power supply to the first plurality of emitters;

wherein current in the solid-state lighting circuit as provided by the constant current power supply is biased toward the first plurality of emitters until a preselected current limit is reached for the first plurality of emitters, such that the first plurality of emitters outputs the light of the first color; and wherein when current that is provided by the constant current power supply is at or above the preselected current limit, current passes through the second plurality of emitters such that the second plurality of emitters outputs the light of the second color.

19. A method for changing the net color output of a solid-state lighting device, comprising:

receiving an input current;

emitting light of a first color from a first plurality of emitters in response to the input current, the first plurality of emitters operably connected to a current limiting circuit and at least one biasing resistor that provides a preselected current limit for the first plurality of emitters;

biasing the input current toward the first plurality of emitters until the preselected current limit is reached, such that the first plurality of emitters outputs the light of the first color; and emitting light of a second color from a second plurality of emitters in response to the input current when the preselected current limit for the first plurality of emitters is met or exceeded, the second color being different than the first color.

20. The method of claim 19, further comprising until the preselected current limit is reached, increasing a brightness of the light of the first color as the input current increases.

21. The method of claim 20, further comprising, after the preselected current limit is reached, maintaining a maximum brightness of the light of the first color as the input current increases.

22. The method of claim 21, further comprising, after the preselected current limit is reached, increasing a brightness of the light of the second color as the input current increases.

* * * * *